United States Patent [19]

Udelhofen et al.

[11] 4,231,759

[45] Nov. 4, 1980

[54] LIQUID HYDROCARBON FUELS CONTAINING HIGH MOLECULAR WEIGHT MANNICH BASES

[75] Inventors: John H. Udelhofen, Wheaton; Roger W. Watson, Batavia, both of Ill.

[73] Assignee: Standard Oil Company (Indiana), Chicago, Ill.

[21] Appl. No.: 340,016

[22] Filed: Mar. 12, 1973

[51] Int. Cl.[3] ..... C10L 1/22

[52] U.S. Cl. ..... 44/75

[58] Field of Search ..... 44/58, 73, 62, 75

[56] References Cited

U.S. PATENT DOCUMENTS 3,948,619 4/1976 Worrel ..... 44/58

*Primary Examiner*—Winston A. Douglas
*Assistant Examiner*—Y. Harris-Smith
*Attorney, Agent, or Firm*—Frank J. Sroka; William T. McClain; William H. Magidson

[57] ABSTRACT

Reaction products obtained from the Mannich condensation of high molecular weight alkyl-substituted hydroxy aromatic compounds, amines and aldehydes provide improved detergency in liquid hydrocarbon fuels. Optionally, a non-volatile hydrocarbon carrier fluid may be included.

9 Claims, No Drawings

LIQUID HYDROCARBON FUELS CONTAINING HIGH MOLECULAR WEIGHT MANNICH BASES

BACKGROUND OF THE INVENTION

Typical hydrocarbon fuels, boiling in the gasoline range and intended for the use in spark-ignition internal combustion engines which power most automotive units, contain components which possess limited volatility or solubility in the fuels. In practice such components tend to form deposits in the fuel carburetion system where fuel vaporization occurs. Deposit accumulations on carburetor throttle bodies and plates and intake valves lead to progressively poorer engine performance. Poor performance is exhibited to the operator most noticeably as improper or rough idling of the engine. Less noticeable by the operator is the excessive consumption of fuel and, least of all, the increased level of hydrocarbons and partially burned fuel components in the exhaust gas. Means for preventing or eliminating deposits in carburetor and intake valve systems thus contribute significantly not only to automotive efficiency and economy of operation but also to minimizing pollution of the environment.

Accumulated deposits may be removed periodically by physical cleaning during engine overhaul or tune-up. A preferred solution to the deposits problem requires no interruption of engine usage and this is usually accomplished in practice by inclusion of a carburetor detergent additive in the gasoline fuel. Detergents employed for this purpose are not completely effective but have reduced the severity of the problem.

There is a continuing need for an agent possessing detergency properties such that carburetor deposits may be completely eliminated. The importance of this need is now emphasized by the widespread awareness of pollution problems and the desire to minimize the emission of pollutants from automotive exhaust systems.

Carburetor detergent additives must be soluble in the hydrocarbon fuel composition and possess a suitable balance of lyophilic and hydrophilic properties. Carburetor detergents of the art, while generally alleviating the deposits problem, have exhibited hydrophilic surface-active properties to such a degree that water suspension (haze) and dispersion (emulsion) occur. There continues to be a need for a suitable carburetor detergent additive for automotive systems effective in removing and preventing deposits on carburetor surfaces while exhibiting no undesirable effects upon other properties of the gasoline boiling range hydrocarbon fuel.

New designs for automotive power units make provision for recycle of gases which contain some partially oxidized hydrocarbons having a tendency for form deposits at or near the intake valves. Accordingly, suitable detergent additives for use in automotive fuels must be capable of keeping intake valves clean. There is a need for a suitable intake valve detergent additive for automotive systems effective in removing and preventing deposits in the intake system while exhibiting no undesirable effects upon other properties of the hydrocarbon fuel. Desirably a suitable detergent additive for use in gasoline range hydrocarbon fuel will provide and maintain a high degree of cleanliness in both carburetor and intake systems.

One effective polar grouping suitable for inclusion in oil-soluble surface-active agents is the basic amine grouping, most often as a polyamine and preferably as a polyalkylene polyamine. One suitable non-polar grouping for such agents is the alkaryl group usually provided by alkylation of benzene, naphthalene, phenol or homologs thereof. Such polar and non-polar groups may be conveniently brought together in one molecular by the well-known Mannich condensation reaction involving an alkyl phenol, a low moleular weight aldehyde and a polyamine.

Mannich condensation reactions usually proceed with the formation of polymeric resinous products, either by linear growth due to the use of mono-substituted phenols, by polysubstitution on primary amine groups, or by substitution on secondary amine groups of the polyamine. Cross-linking is also possible when an unsubstituted phenol or naphthol is used or when the condensation reaction is forced by the use of catalysts, high reaction temperature, or both. Excess aldehyde may also react with amine groups to form imines or hydroxymethylamines. Accordingly, the properties of such polymeric compositions have principally been utilized in heavier fuels such as heater and furnace oils, as described in U.S. Pat. No. 2,962,442, and in lubricating oils, as disclosed in U.S. Pat. Nos. 3,036,003 and 3,539,633. None of these uses involves a sensitive carburetion system as is found in the gasoline-powered spark-ignition internal combustion system.

Polymeric Mannich condensation products have often been employed as stabilizers, or anti-oxidants, as well as dispersants, or detergents, in heavy hydrocarbon stocks. Use in lighter hydrocarbon stocks such as gasolines, has been discloed in U.S. Pat. Nos. 3,269,810 and 3,649,229.

U.S. Pat. No. 3,235,484 (Now U.S. Pat. No. Re. 26,330) describes the addition of certain disclosed compositions to refinery hydrocarbon fuel stocks for the purpose of inhibiting the accumulation of carbonaceous deposits in refinery cracking units. The primary inhibitors disclosed are mixtures of amides, imides and amine salts formed by reacting an ethylene polyamine with hydrocarbon substituted succinic acids or anhydride, whose hydrocarbon substituent has at least about 50 carbon atoms. As an adjunct for such primary carbonaceous deposit inhibitors there is disclosed in said patent Mannich condensation products formed by reacting (1) alkylphenol, (2) an amine and (3) formaldehyde in the ratio of one mole alkylphenol and from 0.1–10 mole each of formaldehyde and amine reactant.

U.S. Pat. No. 3,368,972 describes as dispersant-detergent addition agents for lubricating oils high molecular weight Mannich condensation products from (1) high molecular weight alkyl-substituted hydroxyaromatic compounds whose alkyl-substituent has a molecular weight in the range of 600–3000, (2) a compound containing at least one HN< group and (3) an aldehyde in the respective molar ratio of 1.0:0.1–10:1.0–10.

The high molecular weight Mannich condensation products of either U.S. Pat. No. 3,235,484 or U.S. Pat. No. 3,368,972 have a drawback in their large-scale preparation and in their extended service used as lubricant addition agents used under high temperature conditions such as encountered in diesel engines. In the large-scale or plant preparation of such high molecular weight condensation products, especially in light mineral oil solvents, the resulting oil concentrate solution of the condensation product either has or develops during storage a haze which is believed to be caused by undissolved or border-line soluble by-products which not only are not substantially incapable of removal by filtration but also severely resrict product filtration rate. When used in diesel engine crankcase lubricant oils and subject to high temperature in service use, piston ring groove carbonaceous deposits and skirt varnish tend to build up sufficiently rapidly and prevent desirable long in-service use of such lubricant oils.

Various olefin polymers have been added to hydrocarbon fuels ranging from gasolines to diesel fuels to heavy oil fractions. Petrolatums have also been employed in gasolines. One recent example of such use of certain olefin polymers is described in U.S. Pat. No. 3,502,451, where gasoline motor fuel is claimed to be improved in its ability to maintain cleanliness of intake valves and parts.

SUMMARY OF THE INVENTION

This invention pertains to improved gasoline hydrocarbon fuels containing a detergent additive capable of substantially removing and preventing buildup of deposits on carburetor surfaces and intake valve systems in a gasoline-powered engine system.

In accordance with this invention, there is provided a liquid hydrocarbon combustion fuel containing an amount sufficient to impart improved detergency and antirust properties thereto of an additive composition comprising the Mannich condensation product of (1) a high molecular weight alkyl-substituted hydroxyaromatic compound wherein said alkyl has a molecular weight of from about 600 to about 3,000, (2) an amine which contains an HN< group and, (3) an aldehyde, wherein the respective molar ratio of reactants is 1:0.1–10:0.1–10. The Mannich condensation product may be employed alone where carburetor cleanliness is desired or in combination with a suitable essentially non-volatile hydrocarbon as a carrier fluid where intake valve cleanliness is also desired.

DESCRIPTION OF THE INVENTION

This invention relates to a liquid hydrocarbon combustion fuel containing an amount sufficient to impart improved detergency properties thereto of an additive composition comprising the condensation product of a high molecular weight alkyl-substituted hydroxyaromatic compound, an amine which contains an amino group having at least one active hydrogen atom, and an aldehyde.

Such condensation products can be prepared by condensing in the usual manner under Mannich reaction conditions:

(1) an alkyl-substituted hydroxyaromatic compound, whose alkyl-substituent has a 600–100,000 $\overline{Mn}$, preferably a polyalkylphenol whose polyalkyl substituent is derived from 1-mono-olefin polymers having a $\overline{Mn}$ of about 600–3000, more preferably about 750–1200;

(2) an amine containing at least one >NH group, preferably an alkylene polyamine of the formula $$NH_2-(A-\underset{\underset{H}{|}}{N})_{nx}-H,$$

wherein A is a divalent alkylene radical having 2 to 6 carbon atoms and x is an integer from 1 to 10; and (3) an aldehyde, preferably formaldehyde.

The foregoing high molecular weight products employed in the fuels of this invention are preferably prepared according to the conventional methods heretofore employed for the preparation of Mannich condensation products, using the above-named reactants in the respective molar ratios of high molecular weight alkyl-substituted hydroxyaromatic compound, amine and aldehyde of approximately 1.0:0.1–10:0.1–10. A suitable condensation procedure involves adding at a temperature of from room temperature to about 200° F. the formaldehyde reagent (e.g. Formalin) to a mixture of reagents (1) and (2) above alone or in an easily removed organic solvent, such as benzene, xylene or toluene or in solvent-refined neutral oil and then heating the reaction mixture at an elevated temperature (250°–350° F.) while preferably blowing with an inert stripping gas, such as nitrogen, carbon dioxide, etc. until dehydration is complete. The product so obtained is finished by filtration and dilution as desired.

The preferred detergent additives employed in this invention are high molecular weight Mannich condensation products, formed by reacting (1) an alkylphenol, whose alkyl group has 600–3,000 $\overline{Mn}$; (2) an ethylene polyamine, an amine reactant; and (3) a formaldehyde-affording reactant in the respective molar ratio of 1.0:0.5–2.0:1.0–3.0.

Representative of the high molecular weight alkyl-substituted hydroxyaromatic compounds are polypropylphenol, polybutylphenol and other polyalkylphenols. These polyalkylphenols may be obtained by the alkylation, in the presence of an alkylating catalyst, such as $BF_3$, of phenol with high molecular weight polypropylene, polybutylene and other polyalkylene compounds to give alkyl substituents on the benzene ring of phenol having an average 600–100,000 $\overline{Mn}$.

The 600 $\overline{Mn}$ and higher $\overline{Mn}$ alkyl-substituents on the hydroxyaromatic compounds may be derived from high molecular weight polypropylenes, polybutenes and other polymers of mono-olefins, principally 1-mono-olefins. Also useful are copolymers of mono-olefins with monomers copolymerizable therewith wherein the copolymer molecular contains at least 90%, by weight, of mono-olefin units. Specific examples are copolymers of butenes (butene-1, butene-2 and isobutylene) with monomers copolymerizable therewith wherein the copolymer molecule contains at least 90% by weight, of propylene and butene units, respectively. Said monomers copolymerizable with propylene or said butenes include monomers containing a small proportion of unreactive polar groups such as chloro, bromo, keto, ether, aldehyde, which do appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene and the like. From the foregoing limitation placed on the monomer copolymerized with propylene or said butenes, it is abundantly clear that said polymers and copolymers of propylene and said butenes are substantially aliphatic hydrocarbon polymers. Thus the resulting alkylated phenols contain substantially alkyl hydrocarbon substituents having $\overline{Mn}$ upward from 600.

In addition to these high molecular weight hydroxyaromatic compounds others which may be used include, exclusive of sulfurized derivatives, high molecular weight alkyl-substituted derivatives of resorcinol, hydroquinone, cresol, catechol, xylenol, hydroxy diphenyl, benzylphenol, phenethylphenol, naphthol, tolynaphthol, among others. Preferred for the preparation of such preferred Mannich condensation products are the polyalkylphenol reactants, e.g., polypropylphenol and polybutylphenol whose alkyl group has a number average molecular weight of 600–3000, the more preferred alkyl groups having a number average molecular weight of 740–1200, while the most preferred alkyl groups is a polypropyl group having a number average molecular weight of 800–850, desirably about 825.

The preferred configuration of the alkyl-substituted hydroxyaromatic compound is that of a para-substituted mono-alkylphenol. However, any alkylphenol readily reactive in the Mannich condensation reaction may be employed. Accordingly, ortho mono-alkylphenols and dialkylphenols are suitable for use in this invention.

Representative amine reactants are alkylene polyamines, principally polyethylene polyamines. Other representative organic compounds containing at least one HN< group suitable for use in the preparation of Mannich condensation products are well known and include the mono and di-amino alkanes and their substituted analogs, e.g., ethylamine, dimethylamine, dimethylaminopropyl amine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Suitable alkylene polyamine reactants include ethylenediamine, diethylene triamine, triethylene tetramine, tetraethylene pentamine, pentaethylene hexamine, hexaethylene heptamine, heptaethylene octamine, octaethylene nonamine, nonaethylene decamine, decaethylene undecamine and mixtures of such amines having nitrogen contents corresponding to the alkylene polyamines, in the formula $H_2N—(A—NH—)_nH$, mentioned before, where A is divalent ethylene and n is an integer from 1 to 10. Corresponding propylene polyamines such as propylene diamine and di-, tri-, tetra-, penta-propylene tri-, tetra-, penta- and hexa- amines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Representative aldehydes for use in the preparation of the high molecular products of this invention include the aliphatic aldehydes such as formaldehyde (including paraformaldehyde and Formalin), acetaldehyde and aldol (b-hydroxybutyraldehyde). We prefer to use formaldehyde or a formaldehyde-yielding reactant.

Such detergent compositions may be employed effectively in any liquid hydrocarbon combustion fuel, preferably any gasoline base stock intended for use in spark-ignition internal combustion engines. The stock may be predominantly aliphatic or aromatic in character and may contain hydrocarbon components boiling within the range from about 50° F. to about 430° F., derived variously from cracking, reforming, alkylation, polymerization and distillation operations conventionally employed in a petroleum refinery. The gasoline may additionally contain butanes for vapor pressure control, metal alkyls for octane improvement, and various additives to minimize oxidation, gas formation, icing in fuel lines or intake systems, and the like.

Dirty carburetors, containing deposits on throttle plates and other surfaces, can be restored to a clean condition by the use of gasolines of our invention containing from about 1 to about 200 lbs./1000 bbls. (PTB) of the described Mannich detergent compositions. Generally it is preferred to use from about 1 to about 25 PTB and most preferably from about 3 to about 12 PTB of the Mannich detergent composition on a 100% active basis. Use of a gasoline fuel composition containing our detergent composition at the above concentration levels will also serve to maintain carburetor surfaces and intake valve systems in an especially clean condition.

The carrier fluid may be used together with the Mannich condensation product already described, particularly where cleanliness in the intake valve system is to be achieved or maintained, may be any suitable hydrocarbon oil which is substantially non-volatile and possesses a viscosity at operating conditions no greater than that of a suitable lubricating oil. The carrier fluid may be, for example, a mineral oil fraction or an olefin polymer. Suitable mineral oils include the various solvent-extracted and/or hydrogen-treated lubricating oil fractions, particularly the SAE 40 oils. Suitable olefin polymers, while not so limited, are suitably the same polymers employed in the alkylation of phenolic materials for use in the Mannich condensation product of this invention. Other suitable carrier fluids include the alkylated phenolic compounds described above and may also include polyalkylphenols not suitable for Mannich condensation reactions such as trialkyl phenols.

Polyolefin carrier fluids should have number average molecular weights within the range from about 600 to about 3,000, preferably about 600 to about 1,400 (about 40–100 carbon atoms). Especially preferred carrier fluids include polybutene, having $\overline{Mn}$ of about 900, and polypropylene, having $\overline{Mn}$ of about 850.

Whenever carrier fluid is employed, it may be added in any amount up to about 800 wt. %, based on Mannich product (40% active), and the amount added will usually depend upon the concentration of Mannich product employed. For example, at low concentrations of Mannich product where only carburetor cleanliness is of concern, little or no carrier fluid is required. However, at the higher dosages of Mannich product used to achieve intake valve cleanliness as well as a higher weight ratio of carrier fluid is to be preferred. In illustration of this relationship; where 5–20 PTB of Mannich product (40% active) is employed to achieve and maintain carburetor cleanliness, no carrier fluid other than the polyolefin already present in the Mannich product (unreacted during alkylation of phenol prior to the Mannich reaction) is required. However, where 100 PTB of the Mannich product (40% active) is employed, for intake valve cleanliness, it is preferred that from about 100 to about 400 wt. % carrier fluid be added. Generally, when employing 1 to about 200 pounds, preferably 1 to about 50 pounds, of Mannich condensation product (100% active) it is desirable, when using a carrier fluid, to employ such fluid in an amount from 1 to about 800 pounds, preferably 1 to about 300 pounds, per thousand barrels of fuel.

For ease of handling the Mannich condensation product, alone or in combination with carrier fluid it is desirable to dilute the material with a light hydrocarbon solvent. An aromatic hydrocarbon, such as a $C_9$ mixture of trimethyl benzene and ethyl toluene or propyl benzene, is preferred because of its solvency power and compatibility with gasoline fuels.

EMBODIMENTS OF THE INVENTION

The following examples are illustrative, without limitation as to scope, of our invention.

EXAMPLE I

Mannich condensation products were prepared by the reaction of selected alkylphenols and alkylene polyamines with aqueous formaldehyde substantially according to the following generalized procedure. To a mixture of X moles of alkylphenol and Y moles of amine, heated to about 180°-200° F., was charged Z moles of aqueous formaldehyde over a period of 30 minutes while maintaining the temperature of the mixture below 200° F. The mixture temperature was maintained at 180°-200° F. with stirring for an additional 30 minutes. Xylene solvent was optionally added. The reaction mixture was then heated to 300°-350° F. and held at the elevated temperature for 2 hours while blowing with an inert gas to assure removal of all water. The reaction product was then cooled filtered and diluted with xylene to provide a concentration level of 40-50 wt. % active Mannich product.

Products were prepared substantially as set forth above to have essentially the compositions listed in Table I.

TABLE I

| Experiment | Alkyl Phenol | | Amine | | Formaldehyde |
|---|---|---|---|---|---|
| Number | Alkyl group (MW) | Moles (X) | Diamine | Moles (Y) | Moles (Z) |
| 1 | Polybutyl (1500) | 1 | Tetraethylene Pentamine | 1 | 2 |
| 2 | Polybutyl (1500) | 1 | Pentaethylene Hexamine | 2 | 2 |
| 3 | Polybutyl (900) | 1 | Ethylene Diamine | 1 | 3 |
| 4 | Polybutyl (900) | 1 | Diethylene Triamine | 1 | 3 |
| 5 | Polybutyl (900) | 1 | Aminoethyl Aminoethanol | 2 | 2 |
| 6 | Polybutyl (350) | 1 | Ethylene Diamine | 1 | 1 |
| 7 | Polybutyl (250) | 1 | Aminoethyl Aminoethanol | 1 | 1 |
| 8 | Polypropyl (850) | 1 | Diethylene Triamine | 1 | 3 |
| 9 | Polypropyl (600) | 1 | Diethylene Triamine | 1 | 3 |

EXAMPLE II

Detergent performance of a series of additive formulations at 3 or 6 PTB (lbs. per 100 bbl.), employing Mannich products prepared as described in Example I, was measured by weighing and also visually rating both a thin metal specimen, fitted into the carburetor throttle plate bore area, and the throttle plate of a 1965 Ford 6-cylinder engine after 20 hours of continuous operation on MS-08 test fuel. (MS test fuel is a certified gasoline, blended by Amoco Oil Company, used by automotive-associated industries as a reference fuel for the testing of fuel and lubricant additives in spark-ignition internal combustion engines. MS-08 contains 0.008 wt. % sulfur.) Operations conditions were:

| | Idle | High Speed |
|---|---|---|
| Cycle Time (min.) | 2.75 | 0.25 |
| Speed (rpm) | 525 ± 25 | 1500 ± 20 |
| Load (bhp) | 0 | 55-60 |
| Coolant temp. (°F.) | 195 ± 5 | — |
| Carburetor air temp. (°F.) | 160 ± 5 | — |
| Air Humidity | 80 ± 5 | 80 ± 5 |
| Carburetor air press. (in. $H_2O$) | +0.5 ± 0.03 | −7 ± 2 |
| Blowby rate to carburetor intake (Cfm) | 1.0 | 4.0 ± 2.0 |
| Air-fuel ratio | 13.0-13.5 | — |
| Mainfold vacuum (in. Hg.) | 17 ± 1.5 | — |

-continued

| | Idle | High Speed |
|---|---|---|
| Distributer Vacuum (in. Hg.) | 0.10 ± 0.05 | 11 ± 1.0 |
| Exhaust back press. (in. $H_2O$) | 1.5 ± 1.0 | 4.0 ± 1.0 |

Each performance rating included a measure of total deposit weight (in mg.) on the metal insert and the throttle plate as well as a cleanliness rating (10=clean). Data are presented in Table II.

TABLE II

| Manich Product | | Deposit Weight, | Cleanliness |
|---|---|---|---|
| Experiment No. | PTB | mg. | (10 = Clean) |
| 1 | 3 | 5.7 | 8.4 |
| 1 | 6 | 6.0 | 9.4 |
| 2 | 6 | 7.8 | 9.2 |
| 4 | 6 | 2.2 | 9.7 |
| 5 | 6 | 6.9 | 9.2 |
| 6 | 6 | 12.0 | 8.8 |
| 7 | 6 | 6.9 | 8.5 |
| Base Fuel | | 19.5 | 6.7 |

The desired combination of a low deposit weight and a high cleanliness rating is especially noted when employing the Mannich product as prepared in Experiment 4 of Example I.

EXAMPLE III

Mannich-type dispersants prepared as described in Example I and in combination with carrier fluids were evaluated as detergents for intake systems, employing MS-08 fuel and a 1967 Chevrolet 6-cylinder, 250 CID engine operated to simulate taxicab service using sequences of the following test cycle for 20 hours.

| Cycle | Time | RPM | Load, bhp |
|---|---|---|---|
| I (Idling) | 20 sec. | 550 | 0 |
| II (Acceleration) | 10 sec. | 2,000 | 52 |
| III (Cruising) | 90 sec. | 1,500 | 18 |

At the conclusion of the test period intake valves and manifolds were rated visually on an arbitrary scale (10=clean). Data are presented in Table III.

Carrier fluids employed included as SAE 40 lubricating oil base stock, polybutylene ($\overline{Mn}$=900), polypropylene ($\overline{Mn}$=850), and alkylphenols derived from each of these polyolefins. In this severe test the most striking effect was on the cleanliness of intake valves. Particularly good results were obtained with Mannich products as prepared in Experiments 4 and 8 of Example I when employed together with either the lubricating oil base stock or a polyolefin synthetic oil.

TABLE III

| Mannich Product* | | | | Cleanliness Ratings | |
|---|---|---|---|---|---|
| Experiment | | Carrier Fluid | | Intake | Intake |
| No. | PTB | Oil | PTB | Value | Manifold |
| 3 | 40 | SAE 40 | 260 | 9.0 | 9.6 |
| 4 | 40 | — | — | 6.7 | 8.9 |
| 4 | 40 | SAE 40 | 130 | 8.6 | 9.9 |
| 4 | 40 | SAE 40 | 260 | 9.3 | 9.7 |
| 4 | 40 | Polybutene (900) | 130 | 9.5 | 9.5 |
| 4 | 40 | Polypropylene (850) | 130 | 9.5 | 9.5 |
| 4 | 30 | Polypropylene (850) | 130 | 9.3 | — |
| 4 | 20 | Polypropylene (850) | 130 | 8.6 | 9.5 |
| 4 | 20 | Polypropyl (850) phenol | 130 | 7.6 | 9.2 |
| 4 | 20 | Polybutyl (900) phenol | 130 | 7.1 | 8.9 |
| 8 | 40 | SAE 40 | 260 | 9.1 | 9.7 |
| 8 | 40 | Polypropylene (850) | 130 | 9.6 | 9.5 |
| 9 | 40 | SAE 40 | 260 | 8.5 | 9.7 |
| Base Fuel | | | | 5.9 | 8.2 |

*100% Active

We claim:

1. A liquid hydrocarbon combustion fuel containing an amount sufficient to impart improved detergency properties thereto of an additive composition comprising the condensation product of (1) a high molecular weight sulfur-free alkyl-substituted hydroxyaromatic compound wherein the alkyl group has a number average molecular weight of from about 600 to about 3,000, (2) an amine which contains an amino group having at least one active hydrogen atom, and (3) an aldehyde, wherein the respective molar ratio of reactants is 1:0.1–10:0.1–10.

2. The liquid hydrocarbon combustion fuel of claim 1 wherein the said condensation product comprises from 1 to about 200 pounds per thousand barrels of fuel.

3. The liquid hydrocarbon combustion fuel of claim 1 wherein the said condensation product comprises from 1 to about 25 pounds per thousand barrels of fuel.

4. The liquid hydrocarbon combustion fuel of claim 1 wherein the molecular weight of the alkyl substituent is from about 750 to about 1,200.

5. The liquid hydrocarbon combustion fuel of claim 1 wherein the alkyl-substituted hydroxyaromatic compound is an alkyl-substituted phenol.

6. The liquid hydrocarbon combustion fuel of claim 1 wherein said aldehyde is selected from the group cosisting of formaldehyde and paraformaldehyde.

7. The liquid hydrocarbon combustion fuel of claim 1 wherein said amine is selected from the group consisting of polyalkylpolyamines, polyalkylpolyamines and aromatic amines.

8. The liquid hydrocarbon combustion fuel of claim 1 wherein said amine is selected from the group consisting of dimethylamine, dimethylaminopropylamine, tetraethylenepentamine, triethylenetetramine and diethylenetriamine.

9. The liquid hydrocarbon combustion fuel of claim 1 wherein said alkyl-substituted hydroxy-aromatic compound is selected from the group consisting of polypropyl phenol and polybutyl phenol.

* * * * *

UNITED STATES PATENT OFFICE

CERTIFICATE OF CORRECTION

Patent No. 4,231,759 Dated November 4, 1980

Inventor(s) John H. Udelhofen and Roger W. Watson

It is certified that error appears in the above-identified patent and that said Letters Patent are hereby corrected as shown below:

| Patent Column | Line | |
|---|---|---|
| 2 | 4 | "molecular" should be --molecule-- |
| 2 | 31 | "discloed" should be --disclosed-- |
| 2 | 35 | "fuel" should be --feed-- |
| 3 | 58 | "$NH_2$-(A-N)nx-H," should be --$NH_2$-$(A\text{-}N)_x$-H-- (H) (H) |
| 4 | 37 | "molecular" should be --molecule-- |
| 4 | 64-65 | "tolynapthol" should be --tolylnapthol-- |
| 5 | 3 | "740-1200" should be --750-1200-- |
| 5 | 61 | "gas" should be --gum-- |

UNITED STATES PATENT OFFICE

CERTIFICATE OF CORRECTION

Patent No. 4,231,759 Dated November 4, 1980

Inventor(s) John H. Udelhofen and Roger W. Watson

It is certified that error appears in the above-identified patent and that said Letters Patent are hereby corrected as shown below:

| Patent Column | Line | |
|---|---|---|
| 6 | 7 | "fluid may" should be --fluid which may-- |
| 7 | 54 | "MS-08" should be --MS-08 fuel-- |

Signed and Sealed this

*Twenty-fourth* Day of *March 1981*

[SEAL]

*Attest:*

RENE D. TEGTMEYER

*Attesting Officer*

*Acting Commissioner of Patents and Trademarks*